US008557002B2

(12) United States Patent
Yang et al.

(10) Patent No.: US 8,557,002 B2
(45) Date of Patent: Oct. 15, 2013

(54) FUEL ADDITIVES FOR ENHANCED LUBRICITY AND ANTI-CORROSION PROPERTIES

(75) Inventors: Jianzhong Yang, Missouri City, TX (US); Paul J. Biggerstaff, Stafford, TX (US)

(73) Assignee: Baker Hughes Incorporated, Houston, TX (US)

( * ) Notice: Subject to any disclaimer, the term of this patent is extended or adjusted under 35 U.S.C. 154(b) by 292 days.

(21) Appl. No.: 12/944,997

(22) Filed: Nov. 12, 2010

(65) Prior Publication Data

US 2012/0117861 A1 May 17, 2012

(51) Int. Cl.

| | |
|---|---|
| ***C10L 1/02*** | (2006.01) |
| ***C10L 1/19*** | (2006.01) |
| ***C10L 1/185*** | (2006.01) |

(52) U.S. Cl.
USPC ..... 44/398; 44/447

(58) Field of Classification Search
USPC ..... 44/398, 400, 447
See application file for complete search history.

(56) References Cited

U.S. PATENT DOCUMENTS

| | | | | |
|---|---|---|---|---|
| 3,542,680 | A * | 11/1970 | Le Suer | 508/223 |
| 5,352,377 | A | 10/1994 | Blain et al. | |
| 5,756,435 | A | 5/1998 | Carey et al. | |
| 5,858,029 | A | 1/1999 | Oumar-Mahamat et al. | |
| 6,156,082 | A | 12/2000 | MacMillan et al. | |
| 7,182,795 | B2 | 2/2007 | Henly et al. | |
| 7,361,629 | B2 | 4/2008 | Loper et al. | |
| 7,772,169 | B2 | 8/2010 | Barnes et al. | |
| 2010/0075876 | A1 | 3/2010 | Claydon | |

FOREIGN PATENT DOCUMENTS

| | | | |
|---|---|---|---|
| WO | 2005087904 | A2 | 9/2005 |

OTHER PUBLICATIONS

STIC EIC1700 Search Report.*

* cited by examiner

*Primary Examiner* — Pamela H Weiss
(74) *Attorney, Agent, or Firm* — Mossman, Kumar & Tyler P.C.

(57) ABSTRACT

The reaction product resulting from the chemical reaction of an alkyl phenol with an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof, has been discovered to improve the properties of various fluids. In a non-limiting example, the reaction products may have an acid number from about 0 to about 50 that may improve the lubricity and/or corrosion of fuels and lubricants, such as hydrocarbon fuels and lubricants, when added thereto.

22 Claims, No Drawings

FUEL ADDITIVES FOR ENHANCED LUBRICITY AND ANTI-CORROSION PROPERTIES

TECHNICAL FIELD

The present invention relates to methods and compositions for improving the lubricity and/or anti-corrosion properties of various fuels, and more particularly relates, in one non-limiting embodiment, to methods and compositions for hydrocarbon fuel additives made from a saturated or unsaturated dicarboxylic acid.

TECHNICAL BACKGROUND

It is well known that in many internal combustion engines the fuel is also the lubricant for the fuel system components, such as fuel pumps and injectors. Many studies of fuels with poor lubricity have been conducted in an effort to understand fuel compositions that have poor lubricity and to correlate lab test methods with actual field use. The problem is general to diesel fuels, kerosene and gasolines, however, most of the studies have concentrated on the first two hydrocarbon fuels.

Since the advent of low sulfur diesel fuels in the early 1990s, relatively large amounts of lubricity additives have been used to provide a fuel that does not cause excessive wear of engine parts. Unfortunately, many commercially available fuel additives tend to freeze or form crystals at lower temperatures common during winter weather. The freezing or formation of crystals makes handling of the additives, and particularly their injection into fuel, difficult. Blending the fuel additive with a solvent can lower the freezing point and reduce the crystal formation temperature, or cloud point. However, addition of a solvent may increase cost and preparation complexity.

Some of the fuel additives presently used may have the disadvantage of solidifying on storage at low temperatures. Often even at room temperature, crystalline fractions may separate and cause handling problems. Diluting the additives with organic solvents only partly solves the problem, since fractions may still crystallize out from solutions or the solution may gel and solidify. Thus, the additives either have to be greatly diluted or kept in heated storage vessels and added via heated pipework.

Thus, it would be desirable if a way could be discovered to enhance the lubricity of a distillate fuel, but the fuel remains homogeneous, clear and flowable at low temperatures. Further, the cold flow properties of a middle distillate fuel with the additive should not be significantly adversely affected.

SUMMARY

There is provided, in one non-limiting form, a fuel composition comprising a distillate fuel and an additive comprising the reaction product of an alkyl phenol or an oxyalkylated alkyl phenol with an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof. The dicarboxylic acid or the anhydride of the dicarboxylic acid may be selected from the group consisting of citraconic anhydride, citraconic acid, itaconic anhydride, itaconic acid, maleic anhydride, maleic acid, succinic anhydride, succinic acid, phthalic anhydride, phthalic acid, azelaic anhydride, azelaic acid, suberic anhydride, suberic acid, sebacic anhydride, sebacic acid, fumaric acid, adipic anhydride, adipic acid, malonic anhydride, malonic acid, and mixtures thereof. This produces an ethoxylated phenyl ester or an acid ester. The acid ester may be further reacted with an epoxide to give a reaction product that has an acid number from about 0 to about 10. The reaction product may have the structure shown below.

There is further provided in another non-limiting embodiment a method of improving the lubricity and/or anti-corrosion properties of a low-sulfur content middle distillate fuel. The method comprises adding to the middle distillate fuel an additive comprising the reaction product of an alkyl phenol with an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof. The amount of the additive is effective to improve lubricity, corrosion, and a combination thereof.

In addition to, or alternative to the above-noted method for improving the lubricity of a hydrocarbon fuel, it is expected that the reaction product may also improve the lubricity of a lubricant, e.g. a motor oil; a transmission fluid, e.g. in an automotive automatic transmission, and in an alcohol, e.g. in methanol and/or ethanol when used as a fuel. Further, it is expected that the reaction product may also reduce the corrosivity of these fluids with respect to metals that they come into contact with, as well as to reduce the corrosivity of hydrocarbon fuels. It is also expected the as-produced products may be used in other hydrocarbon fluids, such as lubricity improvers, asphaltene/wax dispersants, and/or corrosion inhibitors in various field conditions.

DETAILED DESCRIPTION

It has been discovered that the reaction products may improve the properties of certain fluids; for instance they may improve the lubricity and the corrosivity of fuels and lubricants, such as hydrocarbon and/or alcohol fuels and lubricants.

The reaction products are produced through the reaction of an alkyl phenol with a saturated or unsaturated dicarboxylic acid or an anhydride of a saturated or unsaturated dicarboxylic acid. In a non-limiting embodiment, the alkyl phenol can be oxyalkylated. The oxyalkylation may be followed by esterification with the dicarboxylic acid or anhydride of the dicarboxylic acid. The resulting reaction product may be further capped by oxyalkylation to the extent that the final acid number is from about 0 to about 50.

The reaction product may have a structure of a formula selected from the group (I) through (II) consisting of:

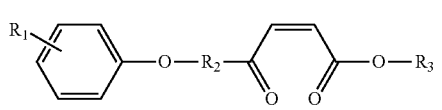

(I)

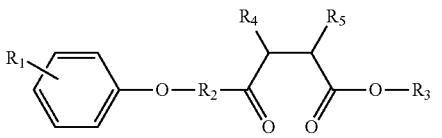

(II)

where:

$R_1$ is a mono or di $C_1$-$C_{30}$ alkyl or alkenyl group, $R_2$ is —$(CH_2CH_2O)_n$—, or —$(CH_2CH_2O)_n$—, or combinations thereof, $R_3$ is —$(CH_2CH_2O)_nH$—, or —$(CH_2CH(CH_3)O)_nH$—, —$CH_2CHOHCH_2OH$—, —CH2CH2CH2CH2OH, or combinations thereof, $R_4$ and $R_5$ are independently hydrogens or $C_1$-$C_{30}$ alkyl or alkenyl groups that may contain O, N, S, or P heteroatoms, or functional groups such as an aromatic ring, an alcohol, an aldehyde, an ester, an amide, and/or a carboxylic acid group; each functional group may have one or more double bonds; and each functional group may be linear, branched or cyclic in nature, and n is an integer from 0 to 10, alternatively from 1 to 5.

The reaction products herein in one useful, non-limiting embodiment, may be essentially non-acidic, due to all of the carboxylic acid groups being reacted or functionalized, with a multifunctional reactant. In an alternate definition, the acid number of the reaction product is less than about 5. Alternatively, the acid number may be less than 3; and in another non-limiting embodiment, the acid number may be from about 0 to about 1. In another non-restrictive version, the acid number may range from about 0 to about 50, alternatively from about 0 independently to about 10. Because these materials are essentially non-acidic or have very low acidity, their ability to contribute to deposit formation tendency of the fluid (e.g. fuel) to which they are added is greatly reduced, and as noted, in some contexts may serve as corrosion inhibitors.

The saturated or unsaturated dicarboxylic acid used to make the additives described herein may have a weight average molecular weight from about 200 to about 5000 and may be selected from the group consisting of citraconic anhydride, citraconic acid, itaconic anhydride, itaconic acid, maleic anhydride, maleic acid, succinic anhydride, succinic acid, phthalic anhydride, phthalic acid, azelaic anhydride, azelaic acid, suberic anhydride, suberic acid, sebacic anhydride, sebacic acid, fumaric acid, adipic anhydride, adipic acid, malonic anhydride, malonic acid, and mixtures thereof having from about 2 to about 30 carbon atoms.

The alkyl phenol is reacted with the dicarboxylic acid, such as citraconic anhydride, citraconic acid, itaconic anhydride, itaconic acid, maleic anhydride, maleic acid, succinic anhydride, succinic acid, phthalic anhydride, phthalic acid, azelaic anhydride, azelaic acid, suberic anhydride, suberic acid, sebacic anhydride, sebacic acid, fumaric acid, adipic anhydride, adipic acid, malonic anhydride, malonic acid, or mixtures thereof. These reactants may be substituted with a linear substituted phenol group or a branched alkyl phenol group, in one embodiment an alkyl phenol group having from about 1 to about 30 carbon atoms. The molar ratio of saturated or unsaturated dicarboxylic acid to the alkyl phenol ranges from about 100:1 independently to about 1:100 in one non-limiting embodiment, in another aspect from about 10:1 independently to about 1:10, alternatively from about 5:1 independently to about 1:5 or in another non-restrictive version from about 2:1 independently to about 1:2 or equimolar. By "independently" it is meant than any of the lower thresholds may be combined with any of the upper thresholds.

Suitable alkyl phenols for use as a reactant with the dicarboxylic acid or anhydride include, but are not necessarily limited to 4-t-butylphenol, nonylphenol, dodecylphenol, dinanophenol, an oxyalkylated alkyl phenol, a linear or branched alkyl phenol, a non-hindered alkyl phenol, a sterically hindered alkyl phenol, each of which may have from about 2 to about 30 carbon atoms and mixtures thereof. Steric hindrance, or steric resistance, may occur when the size of a chemical group added to the phenol prevents a chemical reaction that would otherwise be observed in a related smaller molecule, such as when a t-butyl group occupies the 2,6-positions of a phenol.

The molar ratio of dicarboxylic acid/anhydride to multifunctional reactant ranges from about 10:1 to about 1:10 may range from about 5:1 independently to about 1:5; alternatively from about 2:1 independently to about 1:2.

The reactions to make the functionalized reaction products proceed well without special considerations and are known to those skilled in the art. In general, they may proceed at a temperature range between about 60 to about 240° C. and a pressure range between about 1 to about 10 atm in the presence of a base catalyst, such as an amine, or alternatively with a metal hydroxide. Strong acid catalysts may be used to improve the reaction rate, but no acid catalysts are generally used. The reaction product resulting from the use of maleic anhydride tends to have a lower melting point and is therefore easier to handle at cold temperatures than the reaction product resulting from the use of succinic anhydride.

The compositions and methods described herein relate to lubricity additive compositions for distillate fuels, but also may be useful in products from resid. In the context herein, distillate fuels include, but are not necessarily limited to diesel fuel, kerosene, gasoline middle distillate fuel, and the like. They may also be used in heavy fuel oil. It will be appreciated that distillate fuels include blends of conventional hydrocarbons meant by these terms with oxygenates, e.g. alcohols, such as methanol, ethanol, and other additives or blending components presently used in these distillate fuels, or that may be used in the future. They may also be used in relatively pure alcohols, for instance when an alcohol such as methanol is pumped as a hydrate inhibitor or when ethanol and/or methanol are used as fuels. It is also expected that the reaction products will serve as corrosivity preventers and lubricity enhancers in biofuels. In one non-limiting particular embodiment, the methods and compositions herein relate to low sulfur fuels, which are defined as having a sulfur content of 0.2% by weight or less, and in another non-limiting embodiment as having a sulfur content of about 0.0015 wt. % or less—such as the so-called "ultra low sulfur" fuels. Particularly suitable hydrocarbon fuels herein include, but are not necessarily limited to, diesel and kerosene, and in one non-restrictive version, ultra low sulfur diesel (ULSD) fuels. However, they also may be used for fuels having sulfur contents higher than this.

As previously noted, the reaction products described herein may also be used as corrosivity improvers for the fuels described above, for instance when these fuels come into contact with metal, particularly, but not limited to, iron alloys, particularly the various commonly used steel alloys. Besides use as lubricity enhancers and/or corrosivity improvers for the fuels described above, the reaction products may function as corrosion inhibitors or lubricity enhancers in other fluids including, but not necessarily limited to, lubricants, such as motor oil, transmission fluids, cutting fluids, and the like.

In one non-limiting embodiment of the methods and compositions, the lubricity additive in the total fuel should at least be an amount to improve the lubricity of the fuel as compared to an identical fuel absent the additive. Alternatively, the amount of additive may range from about 10 independently to about 10,000 ppm, and in an alternate embodiment, the lower threshold may be about 10 ppm and the upper threshold may independently be about 1000 ppm, and in one non-limiting embodiment from about 30 independently to about 300 ppm.

When the reaction product additives are used as corrosion inhibitors, for instance in a hydrocarbon fuel or another fluid as previously described, the amount of additive should be that effective to reduce the corrosivity of the fluid as compared to an identical fuel absent the additive. In one non-limiting embodiment, the amount may range from about 10 independently to about 10000 ppm, the lower threshold may be about 10 ppm and the upper threshold may independently be about 1000 ppm, and in one non-limiting embodiment from about 10 ppm to about 100 ppm.

Other, optional components may be added independently to the fluids being treated. In non-limiting embodiments these may include, but are not necessarily limited to, detergents, pour point depressants, cetane improvers, dehazers, cold operability additives (e.g. cold flow improvers), conductivity improvers, other corrosion inhibitors, stability additives, demulsifiers, biocides, dyes, and mixtures thereof. In another non-limiting embodiment of the methods and compositions herein, water is explicitly absent from the inventive composition.

The invention will now be illustrated with respect to certain Examples which are not intended to limit the invention, but instead to more fully describe it.

EXAMPLES 1-4

Preparation of Reaction Products

Example 1

In a typical reaction, a mixture of nonylphenol (176.2 g) with aromatic 100 solvent (44.1 g) was ethoxylated in a stainless steel par reactor using standard procedure with ethylene oxide (35.90 g). The reaction mixture was cooled to 70° C. Maleic anhydride (78.4 g) was added in one portion. The mixture was stirred at 86° C. for 4 hrs and further ethoxylated with ethylene oxide until the acid number was less than 1. The final sample was collected and marked as Example 1.

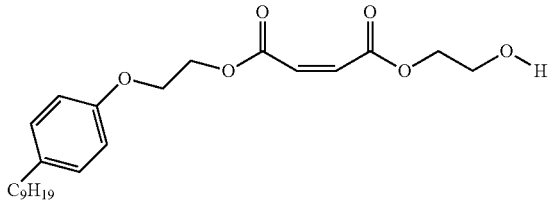

Above is a representative structure of Example 1 material.

Example 2

A mixture of nonylphenol (176.7 g) with aromatic 100 solvent (42.0 g) was ethoxylated in a par reactor using standard procedure with ethylene oxide (44.0 g). The reaction mixture was cooled to 70° C. and a sample of iso-hexadecenylsuccinic anhydride (257.6 g) was added in one portion while stirring. The mixture was stirred at 86° C. until all of the iso-hexadecenylsuccinic anhydride was reacted. The as-produced reaction product was further ethoxylated with ethylene oxide until the acid number was less than 3.

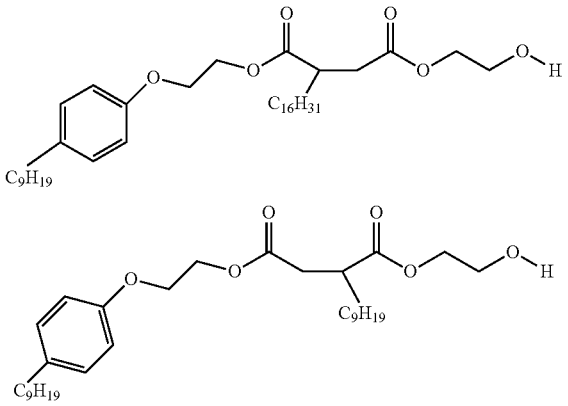

Above are representative structures of Example 2.

Example 3

Oleic acid (200.0 g) and maleic anhydride (55.5 g) were mixed in a 3-neck flask. The mixture was heated sequentially up to 240° C. until the reaction was completed as monitored by FT-IR. The reaction mixture was first cooled to room temperature and then mixed with mono-ethoxylated nonylphenol (125.7 g). The mixture was heated at 86° C. until all of the maleic anhydride was reacted. The reaction mixture was then ethoxylated with ethylene oxide until the acid number is less then 3. The final reaction product was collected. The final product was marked as Example 3.

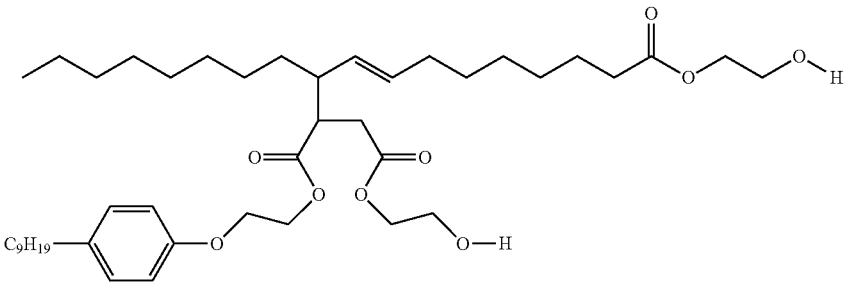

Above is a representative structure of Example 3.

Example 4

Nonylphenol (176.3 g) was mixed with aromatic 100 (44.1 g). The mixture was ethoxylated with ethylene oxide (32.0 g) using standard oxyalkylation procedure that is familiar to those who are skilled in this art. A mono-ethoxylated aliquot sample was evaluated as a lubricity additive.

Effectiveness of Ex. 1-4 Materials as Lubricity Improvers

The additives from Examples 1-4 were examined on a High Frequency Reciprocating Rig (HFRR) in accordance with ASTM D6079 for their effectiveness to improve lubricity. The results are reported in Table I as mean Wear Scar Diameter (WSD) in micrometers. The effectiveness of improved lubricity is measured by a decrease in WSD when comparing the Blank Base Fuel WSD to the WSD with additive. It may be seen that in each instance the reaction products from Examples 1-4 gave improved lubricity results as compared to no lubricity additive.

TABLE I

Results of Lubricity Improver Tests

| Examples # | Fuel | Blank Base Fuel WSD (μm) (No Additive) | Dosage (ppm) | WSD (μm) (w/additive) |
|---|---|---|---|---|
| 1 | Midwest ULSD | 593 | 100 | 452 |
| 2 | West CARB diesel | 611 | 125 | 510 |
| 3 | Western ULSD | 574 | 125 | 508 |
| 4 | Midwest ULSD | 593 | 100 | 589 |

It is to be understood that the invention is not limited to the exact details of reaction conditions, proportions, etc. shown and described, as modifications and equivalents will be apparent to one skilled in the art. Accordingly, the invention is therefore to be limited only by the scope of the appended claims. Further, the specification is to be regarded in an illustrative rather than a restrictive sense. For example, specific combinations of alkyl phenols, saturated or unsaturated dicarboxylic acids and anhydrides of saturated or unsaturated dicarboxylic acids, reactant proportions, reaction conditions, molecular weights, dosages and the like falling within the claimed parameters, but not specifically identified or tried in a particular method, are anticipated to be within the scope of this invention.

The terms "comprises" and "comprising" in the claims should be interpreted to mean including, but not limited to, the recited elements.

The present invention may suitably comprise, consist or consist essentially of the elements disclosed and may be practiced in the absence of an element not disclosed. For instance, the method may consist essentially of or consist of reacting an alkyl phenol with an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof. The fuel composition may consist essentially of or consist of a distillate fuel and a reaction product of an alkyl phenol with an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof as described in the claims, which reaction product may be optionally further esterified and oxyalkylated.

What is claimed is:

1. A fuel composition comprising a distillate fuel and an additive comprising the reaction product of an alkyl phenol with an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof; and wherein the acid or anhydride of the dicarboxylic acid has from about 2 carbon atoms to about 30 carbon atoms.

2. The fuel composition of claim 1 where the alkyl phenol is selected from the group consisting of a non-hindered alkyl phenol, a sterically hindered alkyl phenol, an oxyalkylated alkyl phenol, a linear alkyl phenol, a branched chain alkyl phenol, and mixtures thereof.

3. The fuel composition of claim 2 where the alkyl group of the alkyl phenol has from 1 to 30 carbon atoms.

4. The fuel composition of claim 2 where the alkyl phenol is selected from the group consisting of nonylphenol, dodecylphenol, dinonylphenol, and mixtures thereof.

5. The fuel composition of claim 1 where the dicarboxylic acid or the anhydride of the dicarboxylic acid is selected from the group consisting of citraconic anhydride, citraconic acid, itaconic anhydride, itaconic acid, maleic anhydride, maleic acid, succinic anhydride, succinic acid, phthalic anhydride, phthalic acid, azelaic anhydride, azelaic acid, suberic anhydride, suberic acid, sebacic anhydride, sebacic acid, fumaric acid, adipic anhydride, adipic acid, malonic anhydride, malonic acid, and mixtures thereof.

6. The fuel composition of claim 1 where the alkyl phenol is oxyalkylated.

7. The fuel composition of claim 6 where the oxyalkylated alkyl phenol is esterified by the dicarboxylic acid or the anhydride of the dicarboxylic acid, where the dicarboxylic acid or the anhydride is selected from the group consisting of citraconic anhydride, citraconic acid, itaconic anhydride, itaconic acid, maleic anhydride, maleic acid, succinic anhydride, succinic acid, phthalic anhydride, phthalic acid, azelaic anhydride, azelaic acid, suberic anhydride, suberic acid, sebacic anhydride, sebacic acid, fumaric acid, adipic anhydride, adipic acid, malonic anhydride, malonic acid, and mixtures thereof.

8. The fuel composition of claim 1 where the reaction product is oxyalkylated.

9. The fuel composition of claim 1 where the reaction product is oxyalkylated, and wherein the reaction product has a final acid number from 0 to 50.

10. A fuel composition comprising a distillate fuel and an additive comprising the reaction product of an oxyalkylated alkyl phenol that is esterified by an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof; and wherein the acid or anhydride of the dicarboxylic acid has from about 2 carbon atoms to about 30 carbon atoms.

11. A method of improving the lubricity and/or anti-corrosion properties of a low-sulfur content middle distillate fuel, where the method comprises adding to the middle distillate fuel an additive comprising the reaction product of an alkyl phenol with an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof, where the amount of the additive is effective to improve a property selected from the group consisting of lubricity, corrosion, and a combination thereof; and wherein the acid or anhydride of the dicarboxylic acid has from about 2 carbon atoms to about 30 carbon atoms.

12. The method of claim 11 where the alkyl phenol is selected from the group consisting of a non-hindered alkyl phenol, a sterically hindered alkyl phenol, an oxyalkylated alkyl phenol, a linear alkyl phenol, a branched chain alkyl phenol, and mixtures thereof.

13. The fuel composition of claim 11 where the alkyl group of the alkyl phenol has from 1 to 30 carbon atoms.

14. The method of claim 11 where the non-hindered phenol is selected from the group consisting of nonylphenol, dodecylphenol, dinonylphenol, and mixtures thereof.

15. The method of claim 11 where the dicarboxylic acid or the anhydride of the dicarboxylic acid is selected from the group consisting of citraconic anhydride, citraconic acid, itaconic anhydride, itaconic acid, maleic anhydride, maleic acid, succinic anhydride, succinic acid, phthalic anhydride, phthalic acid, azelaic anhydride, azelaic acid, suberic anhydride, suberic acid, sebacic anhydride, sebacic acid, fumaric acid, adipic anhydride, adipic acid, malonic anhydride, malonic acid, and mixtures thereof.

16. The method of claim 11 where the alkyl phenol is oxyalkylated.

17. The method of claim 16 where the oxyalkylated alkyl phenol is esterified by the dicarboxylic acid or the anhydride of the dicarboxylic acid selected from the group consisting of citraconic anhydride, citraconic acid, itaconic anhydride, itaconic acid, maleic anhydride, maleic acid, succinic anhydride, succinic acid, phthalic anhydride, phthalic acid, azelaic anhydride, azelaic acid, suberic anhydride, suberic acid, sebacic anhydride, sebacic acid, fumaric acid, adipic anhydride, adipic acid, malonic anhydride, malonic acid, and mixtures thereof.

18. The method of claim 11 where the reaction product is oxyalkylated.

19. The method of claim 18 where the oxyalkylated reaction product has a final acid number from 0 to 50.

20. The method of claim 11 where the amount of the additive ranges from 1 to 10,000 ppm based on the middle distillate fuel.

21. The method of claim 11 where the amount of the additive ranges from 30 ppm to 300 ppm based on the middle distillate fuel for improved lubricity, and where the amount of the additive ranges from 10 ppm to 100 ppm based on the middle distillate fuel for corrosion inhibition.

22. A method of improving the lubricity and/or anti-corrosion properties of a low-sulfur content middle distillate fuel, where the method comprises adding to the middle distillate fuel an additive comprising the reaction product of an oxyalkylated alkyl phenol that is esterified by an acid or an anhydride selected from the group consisting of a saturated dicarboxylic acid, an unsaturated dicarboxylic acid, an anhydride of a saturated dicarboxylic acid, an anhydride of an unsaturated dicarboxylic acid, and combinations thereof; and where the amount of the additive is effective to improve a property selected from the group consisting of lubricity, corrosion, and a combination thereof; and wherein the acid or anhydride of the dicarboxylic acid has from about 2 carbon atoms to about 30 carbon atoms.

* * * * *